US008003904B2

(12) United States Patent
Wu

(10) Patent No.: US 8,003,904 B2
(45) Date of Patent: Aug. 23, 2011

(54) DIMMER SWITCH

(75) Inventor: Yun Wu, Bayside, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 11/675,329

(22) Filed: Feb. 15, 2007

(65) Prior Publication Data

US 2007/0193863 A1 Aug. 23, 2007

Related U.S. Application Data

(60) Provisional application No. 60/775,739, filed on Feb. 22, 2008.

(51) Int. Cl.
*H01H 3/00* (2006.01)
*H01H 3/16* (2006.01)

(52) U.S. Cl. ..... 200/61.72; 200/18; 323/905

(58) Field of Classification Search ..... 200/18, 200/61.72, 318, 553, 556; 323/905
See application file for complete search history.

(56) References Cited

U.S. PATENT DOCUMENTS 5,012,495 A * 4/1991 Munroe et al. ..... 337/3
5,262,678 A * 11/1993 Flowers et al. ..... 307/125
5,945,647 A * 8/1999 Hoskins ..... 200/18
6,005,308 A * 12/1999 Bryde et al. ..... 307/157

OTHER PUBLICATIONS

Either—dictionary.com; Apr. 8, 2011.*

* cited by examiner

*Primary Examiner* — Sean Kayes
(74) *Attorney, Agent, or Firm* — Carter, DeLuca, Farrell & Schmidt, LLP

(57) ABSTRACT

A dimmer switch includes a first switch for coupling to a power source, a second switch, a dimmer module, and a main actuator movable between an operational position and a disconnected position. The main actuator includes a first switch actuator and a second switch actuator. The first switch may be a normally-closed air-gap switch including a lever in contact with the first switch actuator. Movement of the main actuator between the operational position and the disconnected position is effective to open the switch. The main actuator is pivotally and slidably coupled to a frame. A coupling between the main actuator and the frame includes a pivot in a pivot holder; a partial cylindrical surface of the pivot is in contact with a surface of the pivot holder which includes a first portion having a partial cylindrical surface and a second portion having a ramp surface.

21 Claims, 12 Drawing Sheets

DIMMER SWITCH

This application claims the benefit of priority pursuant to 35 U.S.C. §119(e) from U.S. Provisional Application No. 60/775,739, filed Feb. 22, 2006.

FIELD OF THE INVENTION

The present invention relates to an electrical dimmer switch suitable for use in household wiring systems.

BACKGROUND OF THE INVENTION

Household electrical wiring systems often include one or more electrical wiring devices such as dimmer switches that control power to one or more loads. A dimmer switch has a main actuator coupled to a power switch to turn power ON/OFF to the load. An example of such an actuator includes a rectangular shaped paddle or push pad capable of being depressed within a rectangular shaped frame located on the front face of the dimmer. The dimmer switch also includes a dimmer actuator coupled to a dimmer circuit to control the amount of power to the load. In addition, agencies, such as Underwriters Laboratories (UL) and Canadian Standards Association (CSA), require every dimmer switch to have an air-gap switch. An air-gap switch provides a mechanical means of disconnecting power to the dimmer. The air-gap switch should be accessible at the front face of the dimmer switch and be configured so as to be operable without any tools.

A typical dimmer switch has an air-gap switch disposed on the front face of the dimmer which is exposed and thus may detract from the appearance of the dimmer switch. In addition, it is not practical to use the main actuator as an air-gap switch because the spacing between the top and bottom portions of the main actuator and the frame may be relatively thin which limits the movement and prevents the rotation of the main actuator about the frame. Furthermore, conventional main actuators are relatively shallow which makes it difficult to grasp the actuator and pull it outward away from the frame. What is needed is a dimmer switch with a main actuator that can be lifted upward away from the frame to activate an air-gap switch and thereby disable the operation of the dimmer.

SUMMARY OF THE INVENTION

An embodiment of the invention addresses the above-described need by providing a dimmer switch which includes a first switch for coupling to a power source, a second switch connected in series with the first switch, a dimmer module for coupling to a load to deliver an adjustable level of power to the load, and a main actuator movable between an operational position and a disconnected position. The main actuator includes a first switch actuator and a second switch actuator. The second switch actuator is coupled to the second switch while the main actuator is in the operational position; the first switch actuator is coupled to the first switch so that movement of the main actuator between the operational position and the disconnected position is effective to actuate the first switch. When the first switch is a normally-closed switch, movement of the main actuator from the operational position to the disconnected position is effective to open the first switch.

In accordance with an embodiment of the invention, the dimmer switch also includes a frame having a central opening for accommodating the main actuator, and the main actuator is pivotally and slidably coupled to the frame. In an embodiment, a coupling between the main actuator and the frame includes at least one pivot in a pivot holder; the pivot has an end with a partial cylindrical surface in contact with a surface of the pivot holder. This surface includes a first portion having a partial cylindrical surface and a second portion having a ramp surface.

According to a further aspect of the present embodiment of the invention, the first switch is a normally-closed air-gap switch including a lever in contact with the first switch actuator. In an embodiment, the main actuator in the operational position has the first switch actuator in engagement with the lever so that the first switch is not actuated, and in the disconnected position has the first switch actuator in engagement with the lever so that the first switch is actuated, thereby disconnecting the dimmer switch from the power source.

Other features of the present embodiment of the invention will be pointed out in the following description and claims and illustrated in the accompanying drawings, which disclose, by way of example, the principle of the invention and the best mode which is presently contemplated by carrying them out.

BRIEF DESCRIPTION OF THE DRAWINGS

In the drawings in which similar elements are given similar reference characters.

DETAILED DESCRIPTION OF PREFERRED EMBODIMENTS

Figure 1A:
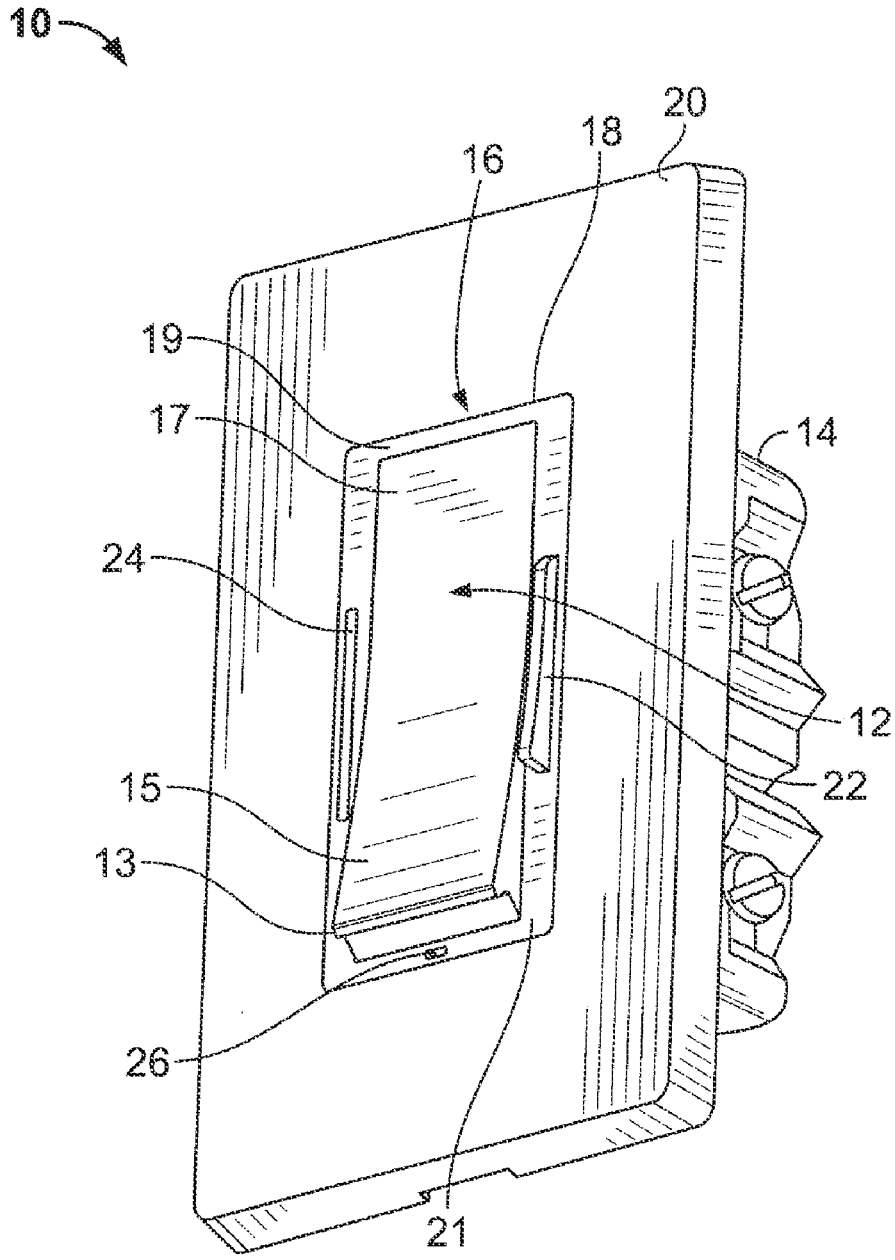
FIG. 1A is a perspective view of a dimmer switch in an operational position in accordance with an embodiment of the invention.

An improved dimmer switch, described in detail below, has a main actuator pivotally coupled to a central opening of a frame such that the main actuator can be lifted upward away from the frame even when a relatively small space is provided between the top and bottom portions of the frame and the main actuator. In an embodiment, an air-gap switch is located behind the main actuator so as to not detract from the appearance of the dimmer. The main actuator and the frame may form a self-contained assembly detachably coupled to the dimmer which allows a user to easily replace the assembly. The front surface of the main actuator may have a smooth curved shape with an angled lip at the bottom portion of the main actuator which allows a user to easily lift open the actuator, thereby activating the air-gap switch and disconnecting power to the dimmer. The main actuator remains in the open or off position until it is reengaged by the user. The shape and contour of the main actuator contribute to a pleasing aesthetic appearance of the dimmer.

In one embodiment, the dimmer includes a main actuator pivotally coupled to a frame so as to engage an air-gap switch and disconnect power to a load. The air-gap switch has an ON position and a disconnected position: In the ON position, the operation of the dimmer switch is enabled which allows power to be delivered to a load, and in the disconnected position, the operation of the dimmer switch is disabled which prevents power from being delivered to the load. The frame has a front face and pivot holders located at the top portion of the frame; the pivot holders have a first surface characterized as a partial cylindrical surface and a second surface characterized as a ramp surface. The main actuator pad has a front face and a top portion and a bottom portion, wherein the top portion has pivots with cylindrical surfaces pivotally and slidably coupled to the pivot holders of the frame and the bottom portion has a means of grasping the main actuator and a means of latching to the bottom portion of the frame.

The main actuator is configured to allow a user to place the dimmer in an operational position during normal operation, and in a disconnected position. In the operational position, the front face of the main actuator may be in relatively the same plane as the front face of the frame and the pivots are resting on the cylindrical surface. In the disconnected position, the plane of the front face of the main actuator is angled relative to the plane of the front face of the frame and the pivots are resting on the ramp surface. The main actuator is held in the disconnected position until a user moves the main actuator back to its operational position.

When the user wants to disconnect power from the dimmer, the user moves the main actuator from its operational position to its disconnected position by lifting the bottom portion of the main actuator upward and away from the frame using the grasping means. This causes the pivots to rotate about the cylindrical surface and then to slide onto the ramp surface, thereby allowing further rotation of the main actuator in order to engage the air-gap switch and to move the air-gap switch to its disconnected position. The main actuator sliding onto the ramp surface opens a gap between it and the frame, allowing further rotation of the main actuator. Thus, the main actuator can be rotated even when it appears that there is no space for such rotation. It is noted that the main actuator remains in the disconnected position until the user moves the main actuator back to its operational position. The user may then move the main actuator pad back to its operational position by pressing the bottom portion of the main actuator pad downward towards the frame using the grasping means which causes the pivots to slide from the ramp surface towards the cylindrical surface and rotate thereabout, thereby causing the main actuator to disengage from the air-gap switch sufficiently so that the air-gap switch moves back to its ON position.

Figure 1B:
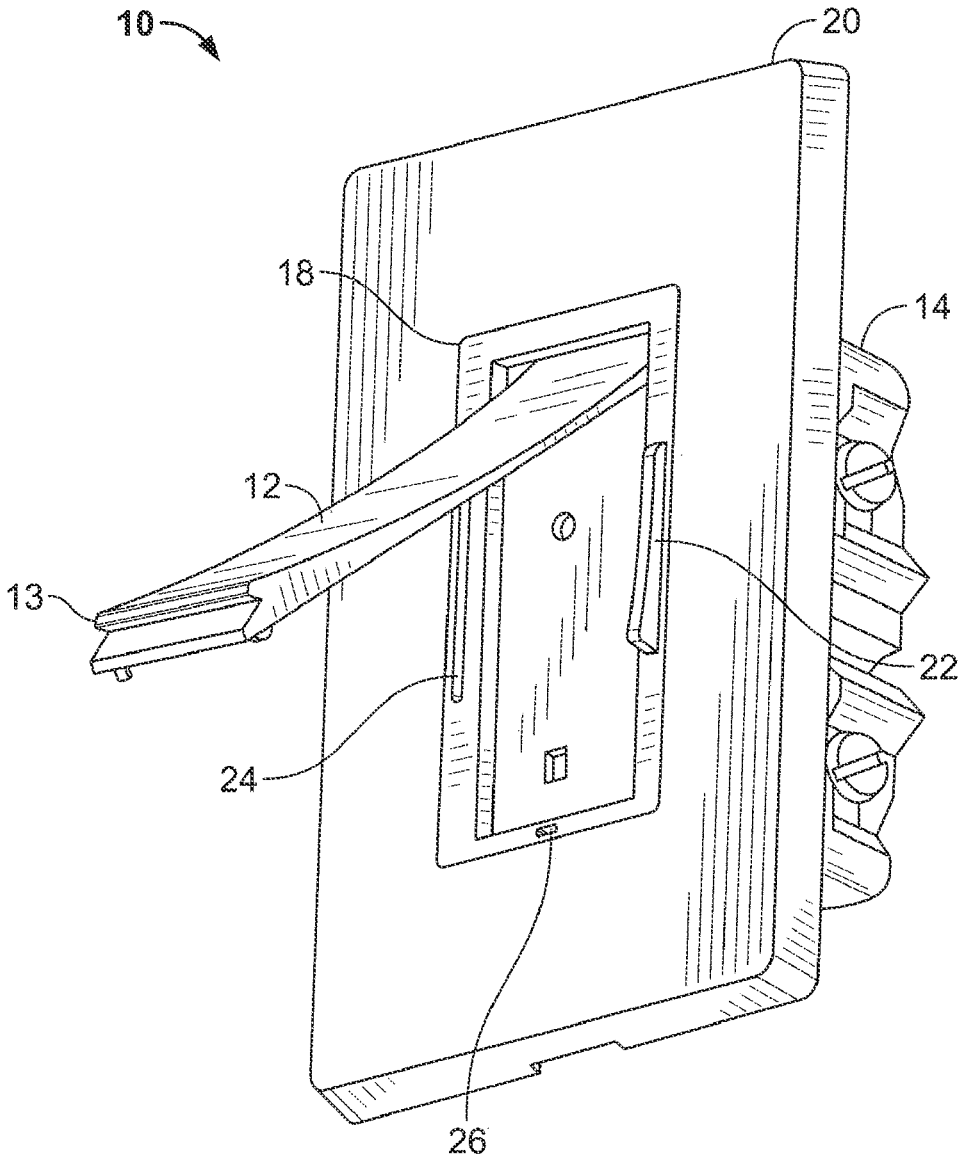
FIG. 1B is a perspective view of the dimmer switch of FIG. 1A in a disconnected position.
Figure 1E:
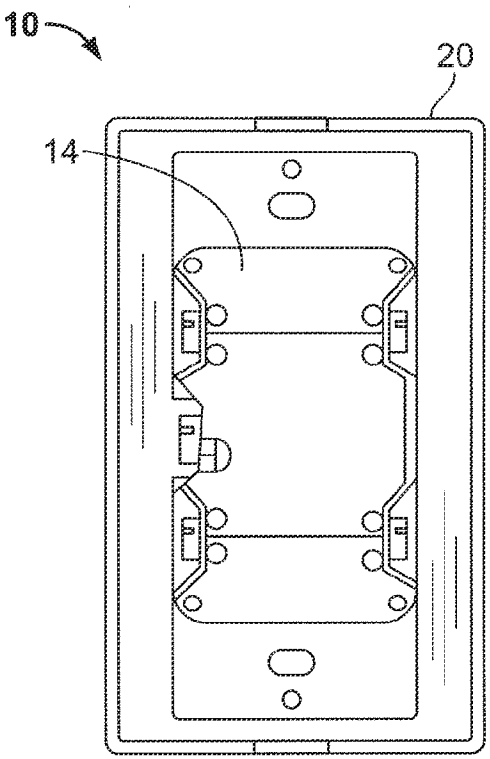
FIG. 1E is a back view of the dimmer switch of FIG. 1A.
Figure 1D:
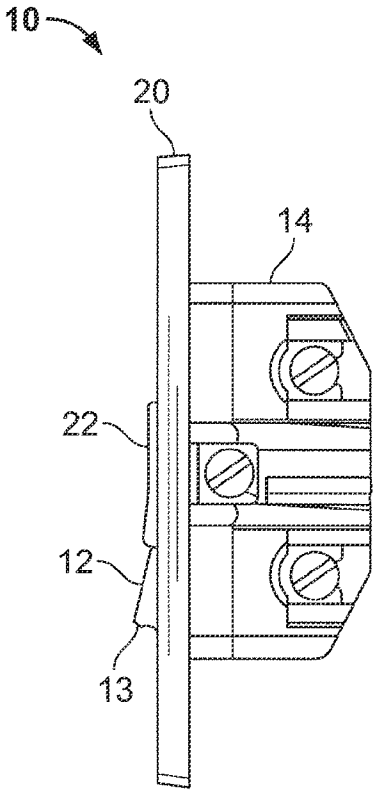
FIG. 1D is a right side view of the dimmer switch of FIG. 1A.
Figure 1C:
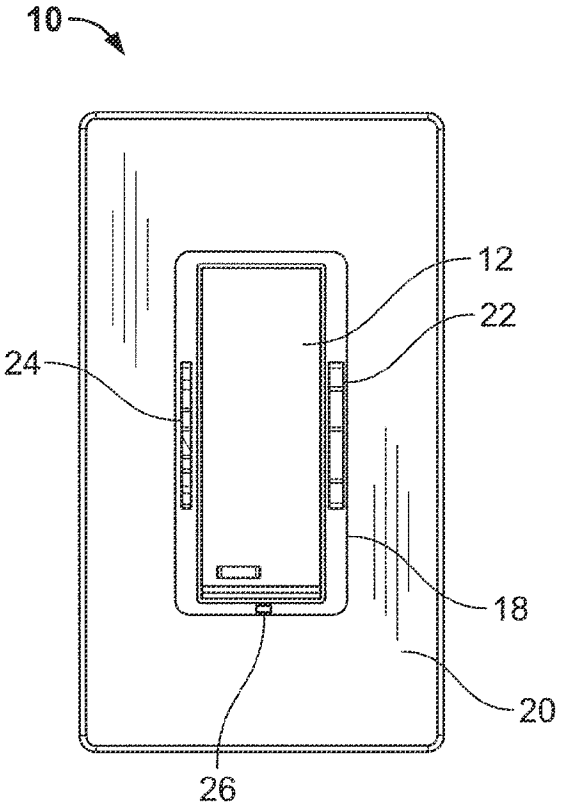
FIG. 1C is a front view of the dimmer switch of FIG. 1A.

FIG. 1A shows a dimmer switch 10 with a main actuator 12 in an operational position, FIG. 1B shows the dimmer 10 with the main actuator 12 in a disconnected position, and FIGS. 1C through 1E show different views of the dimmer 10, in accordance with an embodiment of the invention. As explained in detail below, the main actuator 12 is pivotally and slidably coupled to a frame 18 such that the main actuator can be moved to its operational position (FIG. 1A), causing it to be detachably latched to the frame 18 so that the main actuator is sufficiently disengaged from an air-gap switch to leave the air-gap switch in its ON (normally closed) position. With the air-gap switch in the ON position, the dimmer is electrically enabled, allowing a user to operate the dimmer by activating the main actuator to switch power on or off to a load. To disconnect power to the dimmer, a user can move the main actuator 12 to its disconnected position (FIG. 1B) by lifting the main actuator away from the frame 18; this causes the main actuator to engage the air-gap switch and place it in its disconnected position. With the air-gap switch in the disconnected position, the dimmer is electrically disabled by disconnecting electrical power from the dimmer. The main actuator 12 remains latched in its disconnected position until a user moves it back to its operational position. The air-gap switch is located behind the main actuator and thus not visible from the front of the dimmer 10, so that it does not adversely affect the appearance of the dimmer.

In an embodiment, as shown in FIG. 1A, the dimmer 10 includes a dimmer electrical module 14 coupled to an actuator frame assembly 16 which includes the frame 18 and the main actuator 12.

The dimmer module 14 referred to herein is typically a device well known in the art which may selectively provide a varying portion of the electrical energy available at the input of the dimmer to the load. Such a device, for example, may make use of a switching power supply to supply a fraction of the input voltage to the load, this fraction being selected by the user. One such example may be a device which uses silicon controlled rectifiers which limit the output voltage to a fraction of that of a full sine wave. Similarly, the output voltage of the dimmer may simply be a fraction of the input voltage. Any other suitable dimming mechanism can be used without departing from the spirit of the invention, such as, for example: switching-mode power supplies, rheostats, autotransformers, solid-state circuits, thyristors, and triacs. A variety of such devices are available from Leviton Manufacturing Company, Inc. and other suppliers.

The assembly 16 may be framed by a wall plate 20 configured to allow the front face of the assembly to extend through an opening of the wall plate, thereby providing access to the features of the assembly including the main actuator 12. The main actuator 12 may have a smooth curved front surface along its longitudinal axis with an outwardly angled lip 13 at the bottom portion 15 of the actuator. The top portion 17 of the actuator 12 is pivotally coupled to the top portion 19 of the frame 18 and is free to rotate thereabout. The lip 13 allows the main actuator 12 to be lifted away from the bottom portion 21 of the frame 18 by pivoting about the top portion 19 of the frame. The shape and contour of the main actuator 12 blends with the aesthetic appearance of a dimmer and does not detract away from the appearance of the dimmer. The dimmer 10, including the dimmer electrical module 14, the wall plate 20, and the assembly 16 can be made of a non-conductive material such as plastic or other well known types of electrically non-conductive material. Alternatively, the user accessible surfaces of the dimmer, once installed, need not be non-conductive as long as the user accessible surfaces are electrically isolated from the building electrical system.

The dimmer 10 includes a power switch (not shown but located behind leaf spring actuator 56 in FIG. 3), which like the air-gap switch, is located behind the front surface of the main actuator 12 so as to not detract from the appearance of the dimmer 10. Still referring to FIG. 1A, located on the frame 18, is an opening for a dimmer actuator 22 to adjust the level of power to a load, an opening for an intensity indicator 24 (e.g., a light pipe or linear array of light emitting diodes (LED)) associated with the dimmer actuator 22 to indicate the level of power being delivered to a load, and an opening for a power indicator 26 (e.g., an LED) to indicate the status of the power switch. For an embodiment in which power indicator 26 is an LED, the LED may be configured to be ON when the dimmer is switched OFF allowing a user to locate the dimmer in a dark room. When the dimmer is switched ON, the LED 26 may be configured to be OFF. The air-gap switch may be a multi-terminal normally closed (NC) switch which makes a conductive path across its terminals when it is in its ON (closed) position and breaks the conductive path when it is in its disconnected (open) position. The air-gap switch is coupled in series with the power switch so that when the air-gap switch is in its ON position, the power switch and the dimmer actuator are enabled allowing a user to operate the dimmer. On the other hand, when the air-gap switch is in its disconnected position, electrical power is disconnected from the dimmer so that the power switch and the dimmer actuator are disabled preventing a user from operating the dimmer.

In a typical application, an electrical wiring system of a home may include the dimmer 10 electrically coupled between an alternating current (AC) power source, such as a 120 Volts, 60 Hz power, and a load. For example, the dimmer switch 10 can be connected to a light to control the brightness of the light or connected to a fan to control the speed of the fan. During normal operation the dimmer 10 is placed in its operational position (FIG. 1A) by pressing the lip 13 towards the frame 18 sufficient to cause the lower portion of the main actuator to engage the lower portion of the frame 18 and be held in place by the frame. In the operational position, the main actuator 12 disengages the air-gap switch by placing the air-gap switch in its ON position allowing a user to operate the dimmer 10.

However the dimmer 10 can be placed in its disconnected position (FIG. 1B) by lifting the lip 13 at the lower portion of the main actuator 12 away from the frame 18 so that lower portion of the main actuator 12 disengages from the lower portion of the frame. In the disconnected position, the main actuator 12 engages the air-gap switch placing the air-gap switch in its disconnected position thereby disconnecting power to the load and dimmer. The main actuator 12 remains in the disconnected position until it is moved back to its operational position. Thus, the present invention provides a dimmer with an air-gap switch located behind the main actuator and not visible to a user thereby improving the appearance of the dimmer. The main actuator when rotated to its disconnected position rotates about a cylindrical surface and then slides onto a ramp surface. The main actuator 12 sliding onto the ramp surface results in a gap being formed between the main actuator and frame 18, allowing further rotation of the main actuator 12. Thus, the main actuator 12 can be rotated even when it appears that there is no space for such rotation.

Figure 2B:
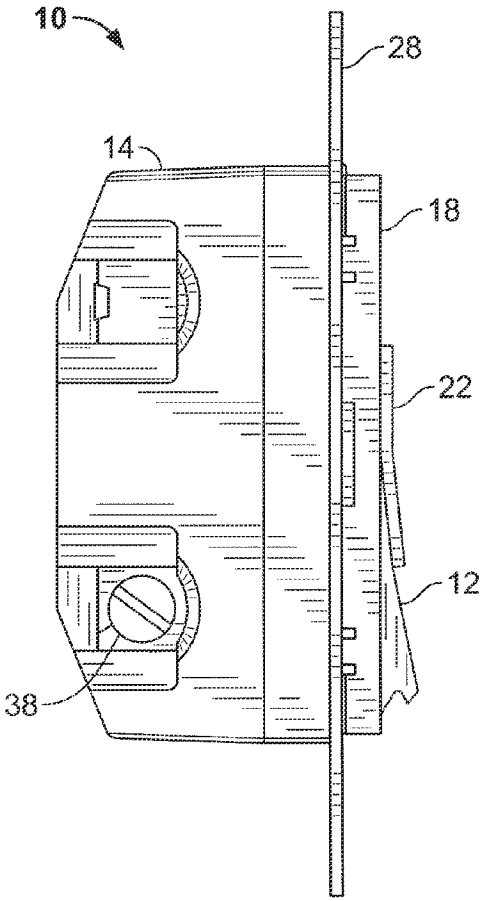
FIG. 2B is a left side view of the dimmer switch of FIG. 1A.
Figure 2A:
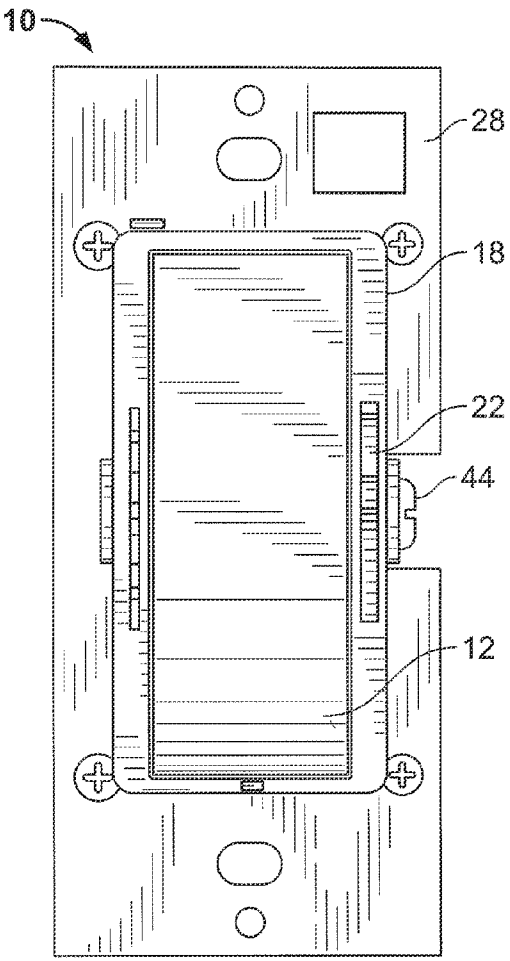
FIG. 2A is a front view of the dimmer switch of FIG. 1A.
Figure 2D:
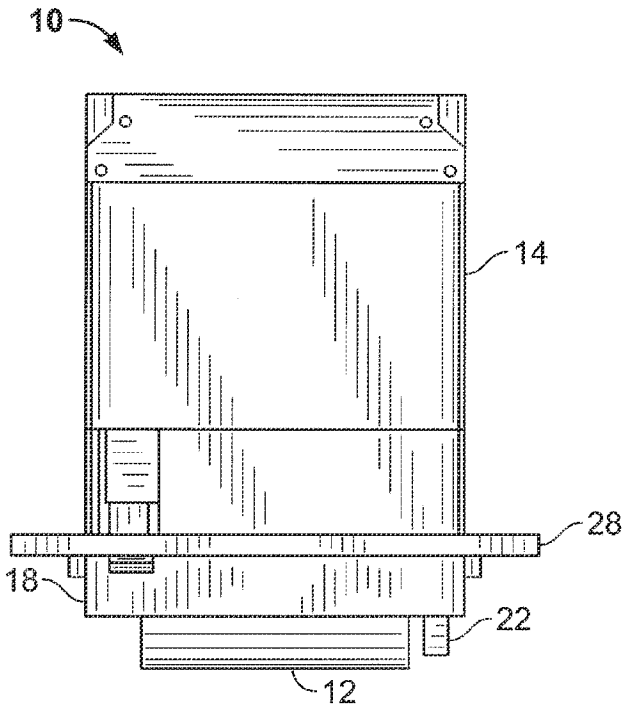
FIG. 2D is a top view of the dimmer switch of FIG. 1A.
Figure 2C:
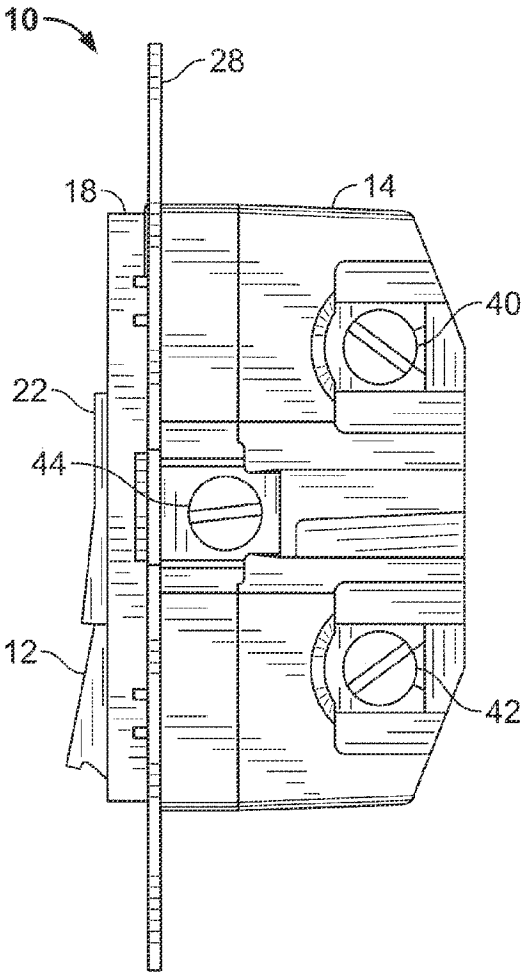
FIG. 2C is a right side view of the dimmer switch of FIG. 1A.
Figure 2E:
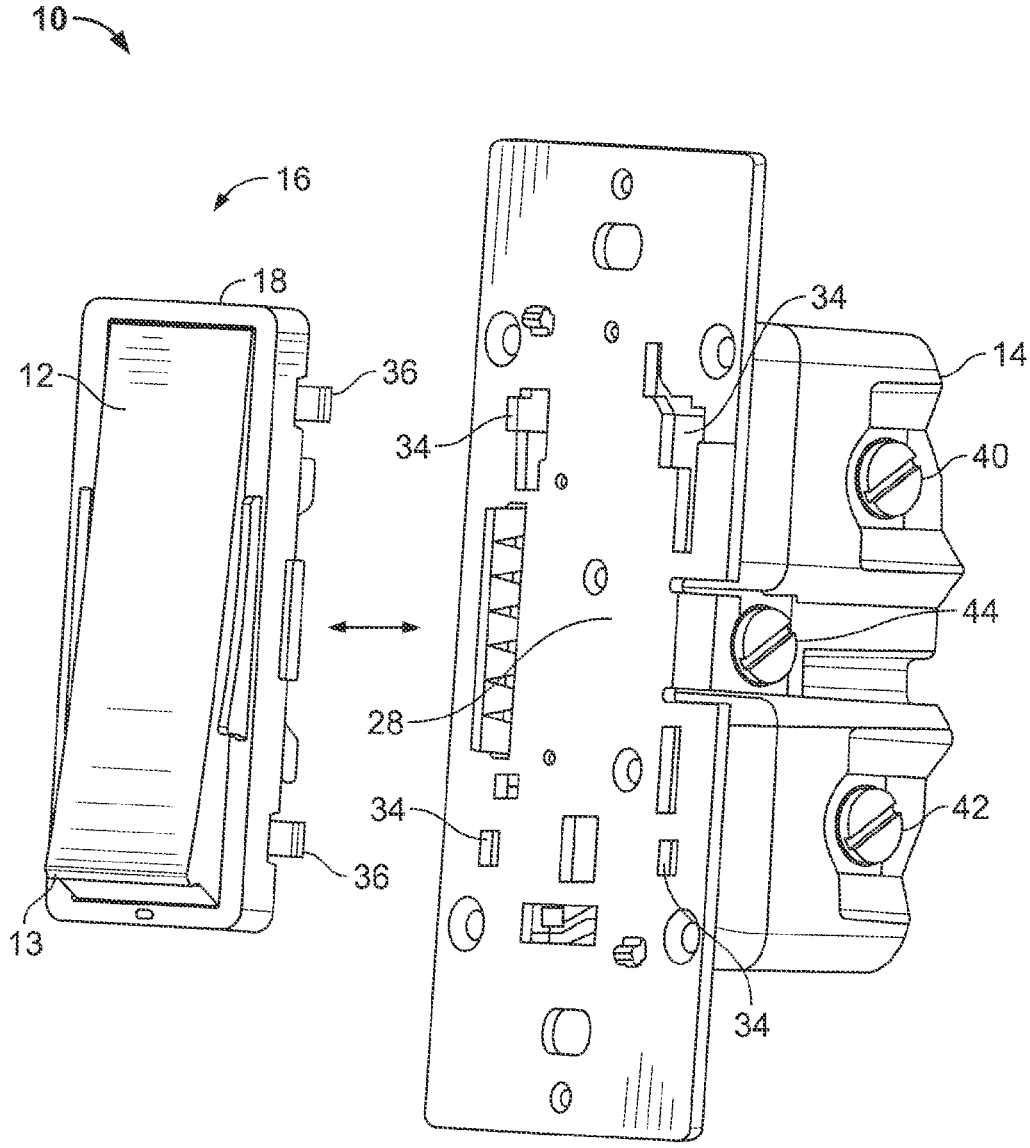
FIG. 2E is a perspective view of the dimmer switch of FIG. 1A with the frame assembly removed.

FIGS. 2A through 2D show various views of the dimmer switch 10 of FIG. 1A but with the wall plate 20 removed to show a mounting plate 28. FIG. 2E shows the dimmer 10 with the dimmer actuator assembly 16 detached from the mounting plate 28. Referring to FIGS. 2A through 2D, the mounting plate 28 is coupled between the dimmer actuator assembly 16 and the front portion of the dimmer module 14. The mounting plate 28 of the present embodiment is a generally rectangular shaped plate with openings 30, 32 (see FIG. 3) located on the top and bottom of the plate to permit the dimmer 10 to be mounted to an electrical junction box (not shown). The mounting plate 28 is sized to be mounted to an electrical junction box and be covered by a wall plate. The dimmer module 14 includes electrical wiring assembly terminals 38, 40, 42 for connection to power conductors (e.g., phase and neutral) and a load of an electrical wiring system. The mounting plate 28 can be made of a conductive material such as aluminum and includes a ground terminal 44 for connection to a ground conductor of an electrical wiring system.

Referring to FIG. 2E, the dimmer 10 is shown with the dimmer actuator assembly 16 detached from the mounting plate 28. The dimmer actuator assembly 16 may be a self-contained unit which comprises frame 18 and main actuator 12. Such a unit may be configured to be detachably coupled to the mounting plate 28 via slots 34 located on the plate 28 and corresponding tabs 36 on the assembly. This feature can allow a user to easily replace an existing assembly with a new assembly, for example, in case the existing assembly is damaged. In another example, if a home is renovated or a wall repainted, a homeowner or user can simply replace an existing assembly with a new assembly having a different style/color which may be part of a color change package. This feature allows an assembly to be replaced without having to remove the dimmer module 14 thereby providing a user with enhanced device choice flexibility.

Figure 3:
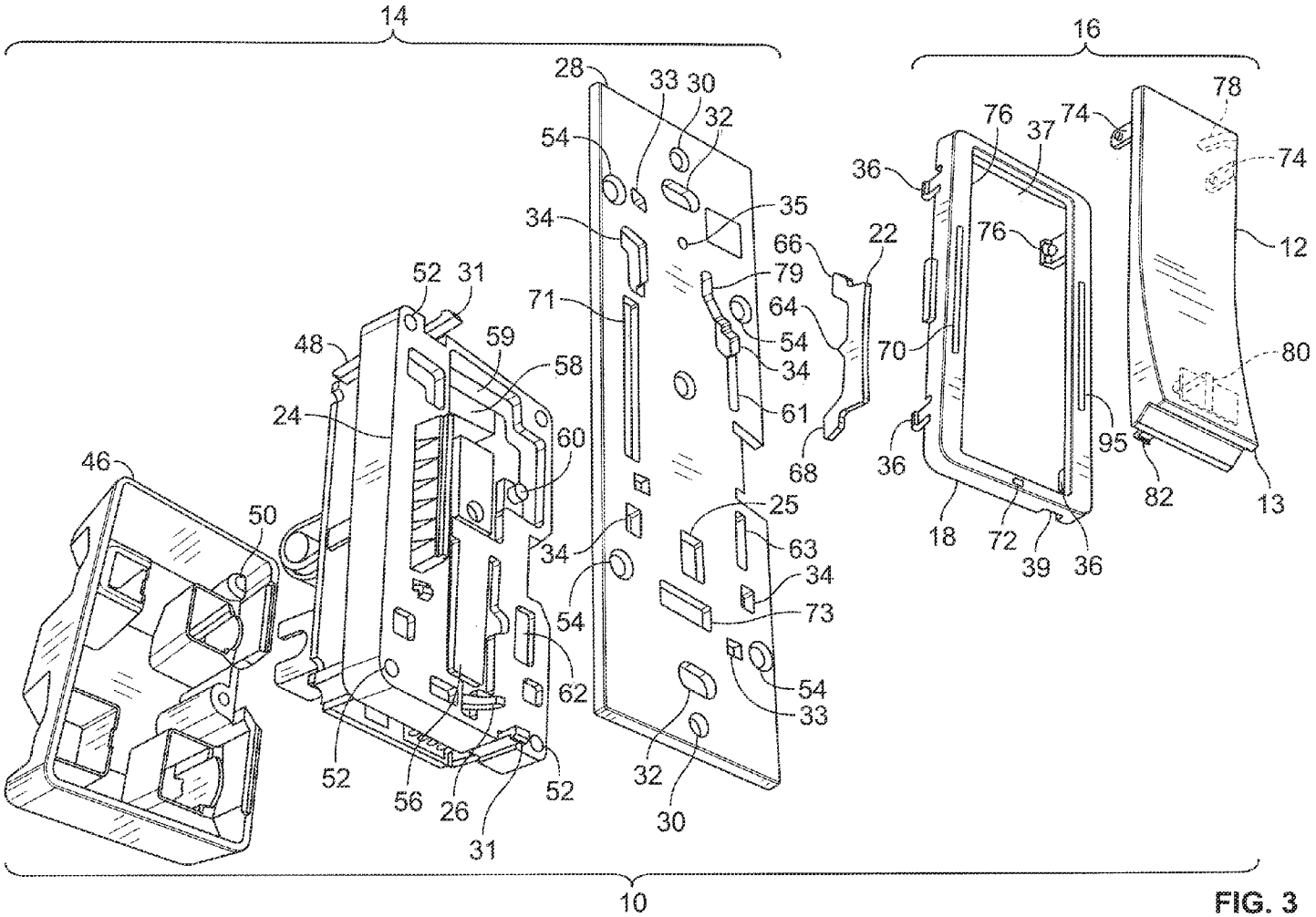
FIG. 3 is an exploded view of the dimmer switch of FIG. 1A.

FIG. 3 shows an exploded view of the dimmer 10 of FIG. 1A. The dimmer of this particular embodiment module 14 includes a first housing 46 having circular threaded openings 50, a second housing 48 having circular openings 52, and mounting plate 28 having circular openings 54. The second housing 48 is mounted between the first housing 46 and mounting plate 28 via screws (not shown) which pass through openings 54, 52 and are secured to threaded openings 50. The second housing 48 supports a printed circuit board (PCB) which holds circuitry for performing dimmer functions such as switching a light on or off and adjusting power to a light. The PCB supports a power switch (not shown) with a leaf spring actuator 56, an air-gap switch 58 with a lever actuator 59, dimmer switches 60, 62 with button actuators, power indicator 26 and intensity indicator 24. It should be noted that the dimmer may be assembled in any of a number of suitable manners not limited to the structure described above.

The dimmer actuator assembly 16 includes the frame 18 and the main actuator 12. The frame 18 includes an elongated opening 95 to allow the front portion of the dimmer actuator 22 to extend therethrough and be accessible to a user. The rear portion of the dimmer actuator 22 has legs 66, 68 which extend through respective openings 61, 63 in the mounting plate 28 and a pivot portion 64 which pivots about a top surface of the mounting plate. The pivot portion 64 allows the actuator 22 to toggle between two positions: In a first position, the dimmer actuator leg 66 extends through opening 61 and makes contact with dimmer switch 60 when the upper portion (leg 66) of the dimmer actuator 22 is pressed; in a second position, the actuator leg 68 extends through opening 63 and makes contact with dimmer switch 62 when the lower portion (leg 68) of the dimmer actuator 22 is pressed. The frame 18 has an elongated opening 70 aligned with an elongated opening 71 on the mounting plate 28 to allow the intensity indicator 24 to extend through the openings and allow light to escape from the indicator. Similarly, the frame 18 has an opening 72 aligned with an opening 73 on the mounting plate 28 to allow the power light indicator 26 to extend through the openings and allow light to escape from the indicator. The four tabs 36 on the frame 18 are configured to detachably mate with the four slots 34 on the mounting plate 28. A slot 39 on the bottom portion of the frame 18 can be used to detach the frame from the mounting plate 28 by, for example, inserting a tool (such as the flat blade portion of a screwdriver) into slot 39 and rotating the tool to pry the frame away from the mounting plate.

The top portion 17 of the main actuator 12 has two pivots 74 located at opposite sides of the main actuator and extending from the rear surface of the main actuator. The top portion of the frame 18 has two pivot holders 76 (only one of which is shown in FIG. 3) extending from opposite sides of the inner wall of the frame. As explained in detail below, the pivot holders 76 may have a cylindrical surface and a ramp surface to allow the pivots 74 to rotate and slide thereabout. The top portion 17 of the main actuator 12 has an air-gap switch actuator 78 extending from the rear surface of the main actuator and aligned with an opening 79 in the mounting plate 28 so as to make contact with air-gap switch lever 59. Similarly, the lower portion of the main actuator 12 has a power switch actuator 80 extending from the rear surface of the main actuator and aligned with an opening 73 of the mounting plate 28; when the main actuator is pressed, actuator 80 extends through the opening 73 to make contact with the flexible portion of a leaf spring 56 and, in turn, contact the button actuator of the power switch. The lower portion of the main actuator 12 also has a latch 82 extending from the rear surface of the main actuator and may be configured to be optionally detachably coupled to the bottom portion of the frame 18. A pin 37 extending from the rear of frame 18 is aligned with a pin hole 35 on the mounting plate 28 which provides a means for orienting the frame 18 to the mounting plate when the frame is mounted to the plate. It should be noted that any suitable method can be used to ensure that the frame 18 is oriented correctly with respect to the mounting plate.

Figure 4A:
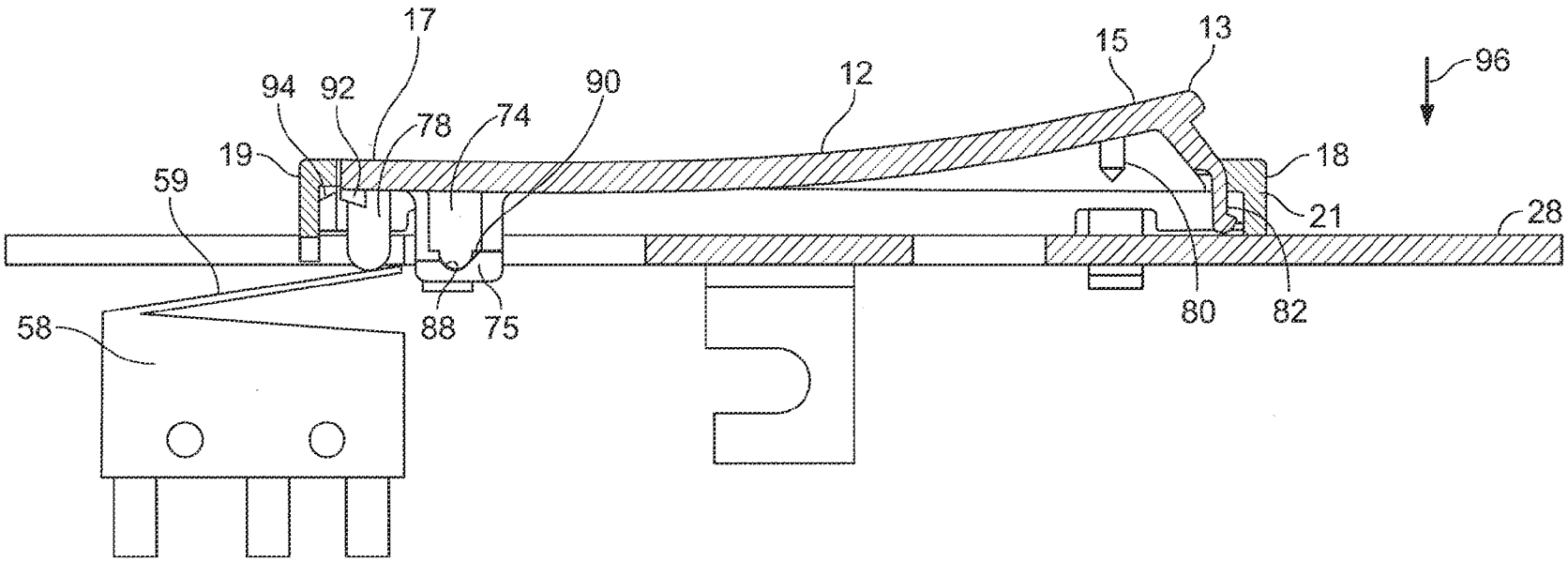
FIG. 4A is a cross-sectional view of the dimmer switch of FIG. 1A in the operational position.
Figure 4B:
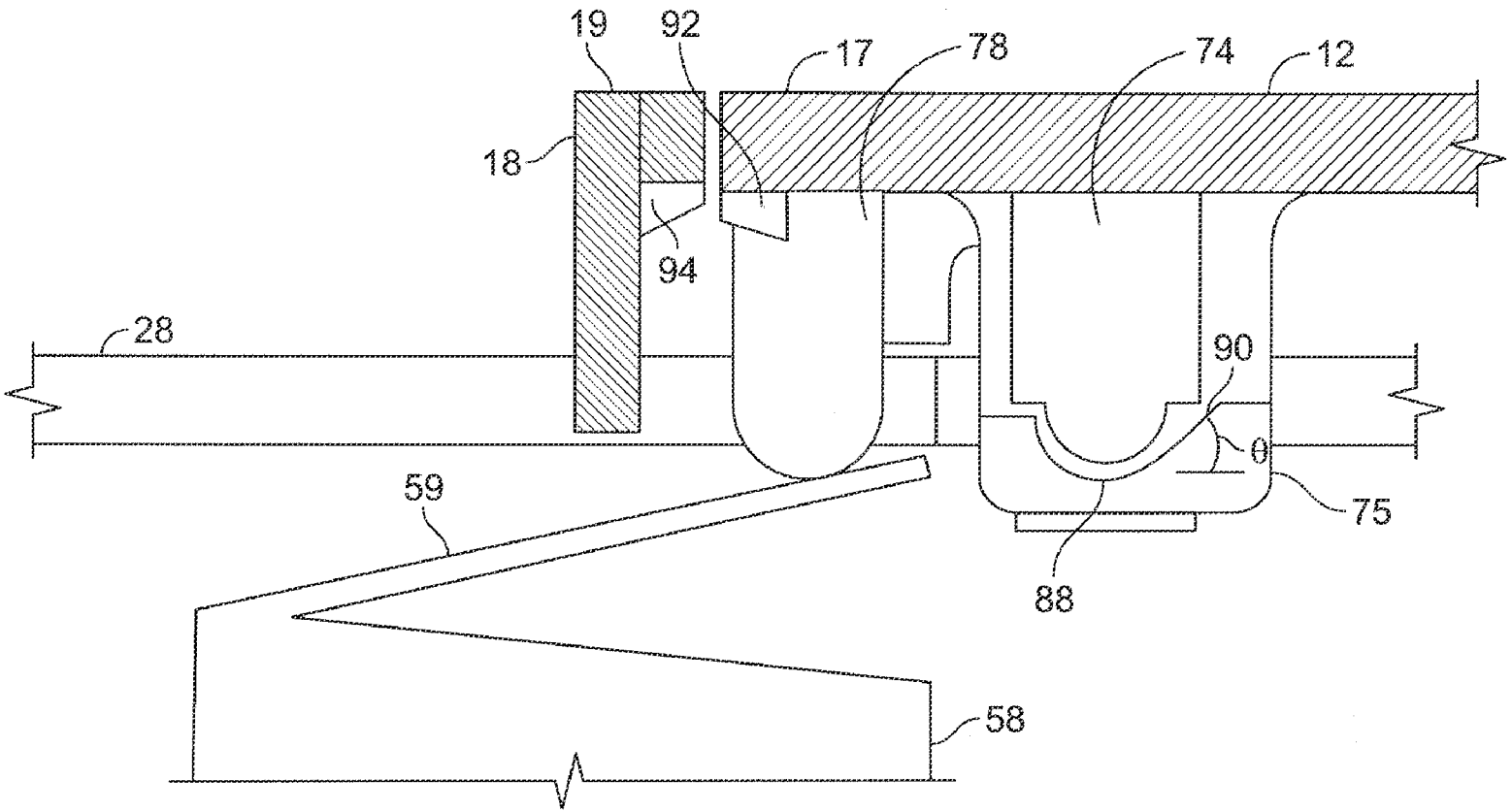
FIG. 4B is a detailed view of the coupling mechanism of FIG. 4A.

FIG. 4A shows a cross-sectional view of the dimmer 10 of FIG. 1A in its operational position; FIG. 4B shows a detailed view of the coupling mechanism of the dimmer. Referring to FIGS. 4A and 4B, the pivot holders 75 (one shown) have a first pivot portion 88 having a first partial cylindrical surface adjacent to a second pivot portion 90 having a ramped angled surface. In the embodiment shown in FIG. 4B, the ramped surface is at an angle θ of approximately 35° with respect to a plane tangent to the cylindrical surface of pivot portion 88. As shown, the pivots 74 (one shown) each have a free end with a partial cylindrical surface which sits in the first pivot holder portion 88. As explained below with reference to FIG. 4C, when the latch 82 is lifted in the direction shown by arrow 98, the pivots 74 slide from the first pivot portion 88 and onto the second pivot portion 90. The frame 18 has two ribs 94 (one shown in FIGS. 4A and 4B) extending from the rear surface of the frame 18. The free end of the ribs 94 has a ramped shaped surface capable of contacting the top surface of the main actuator 12 to help the main actuator rotate about the pivot holders 75. The main actuator 12 may include a stop element 92 extending from the rear surface of the main actuator 12. The free end of the stop element 92 has a ramped shaped capable of contacting the front surface of the mounting plate 28 to help limit further rotation of the main actuator 12. It should be noted that the air-gap switch 58 is shown in FIGS. 4A to 4E rotated 90° relative to FIG. 3, to better show the interaction between the air-gap actuator 78 and the air-gap switch. The main actuator 12 remains in its operational position due in part to the latch 82 being held in place by the lip portion at the bottom portion 21 of the frame. As shown in FIG. 4A, the air-gap actuator 78 is pre-engaged with the air-gap switch lever 59; that is, it makes contact with the lever but does not press on it sufficiently to actuate the switch. Thus, when the main actuator 12 is in the operational position shown in FIG. 4A, the air-gap switch is in its ON position, thereby allowing a user to operate the dimmer 10. For example, the main actuator 12 can be pressed in the direction of arrow 96 to cause the power switch actuator 80 to extend through the opening 73 of the mounting plate 28 (see FIG. 3) to make contact with the spring leaf actuator 56 of the power switch. In addition, the dimmer actuator 22 (shown in FIG. 3) can be pressed between its two positions to adjust power to a load.

Figure 4C:
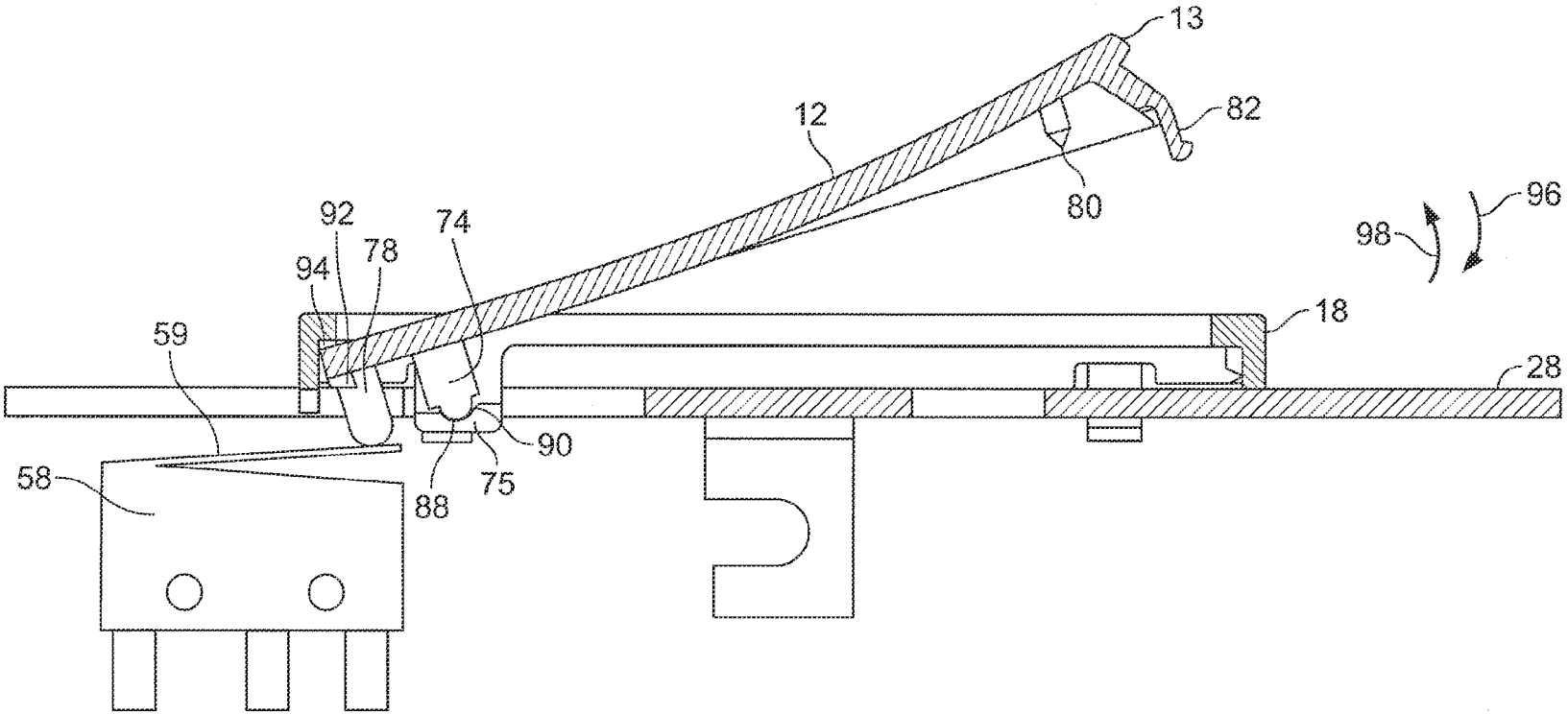
FIG. 4C is a cross-sectional view of the dimmer switch of FIG. 1B in the disconnected position.
Figure 4D:
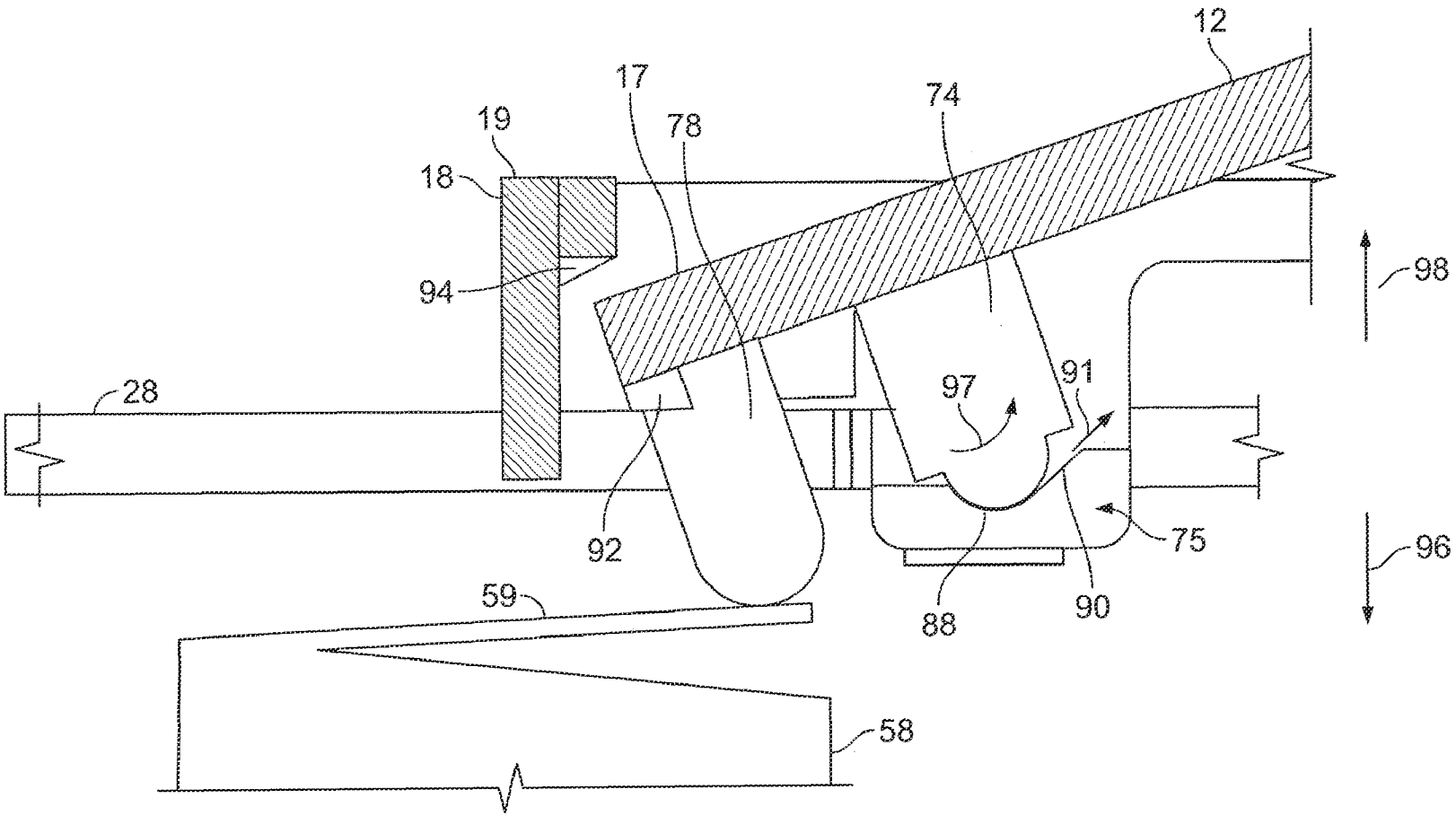
FIG. 4D is a detailed view of the coupling mechanism of FIG. 4C.

FIG. 4C shows the dimmer switch with main actuator 12 in its disconnected position, and FIG. 4D is a detailed view of the coupling mechanism between main actuator 12 and frame 18 and air-gap switch 58. As shown in FIG. 4C, main actuator 12 is moved from its operational position (shown in FIG. 4A) to its disconnected position by first lifting the lip 13 in the direction shown by arrow 98 away from frame 18 to cause latch 82 to be released from a rib underneath the bottom portion of the frame. As the main actuator is moved further in the direction of arrow 98, the ramped shape of the ribs 94 contacts the top portion of the main actuator 12; this helps the pivots 74 rotate in the direction of arrow 97 (see FIG. 4D) about the first pivot holder surface 88 and then slide in the direction of arrow 91 onto the second pivot holder surface 90. The movement of the pivots 74 from the cylindrical surface 88 to the ramped surface 90 helps the main actuator to rotate further (through approximately 18°) relative to the plane of the front surface of frame 18. Such movement also causes the top portion 17 of the main actuator 12 to slide under the top portion of the frame resulting in the actuator being held in the disconnected position. The main actuator is held in the disconnected position due in part to the ribs 94 of the frame 18, which contact the top edge of the main actuator 12, and to the stop element 92 which limits further rotation of the main actuator. In the disconnected position (see FIG. 4D), the air-gap actuator 78 moves in the direction shown by arrow 96 to engage the lever 59 of the air-gap switch 58; this places the air-gap switch in its disconnected position, thereby disconnecting power from the load.

Figure 4E:
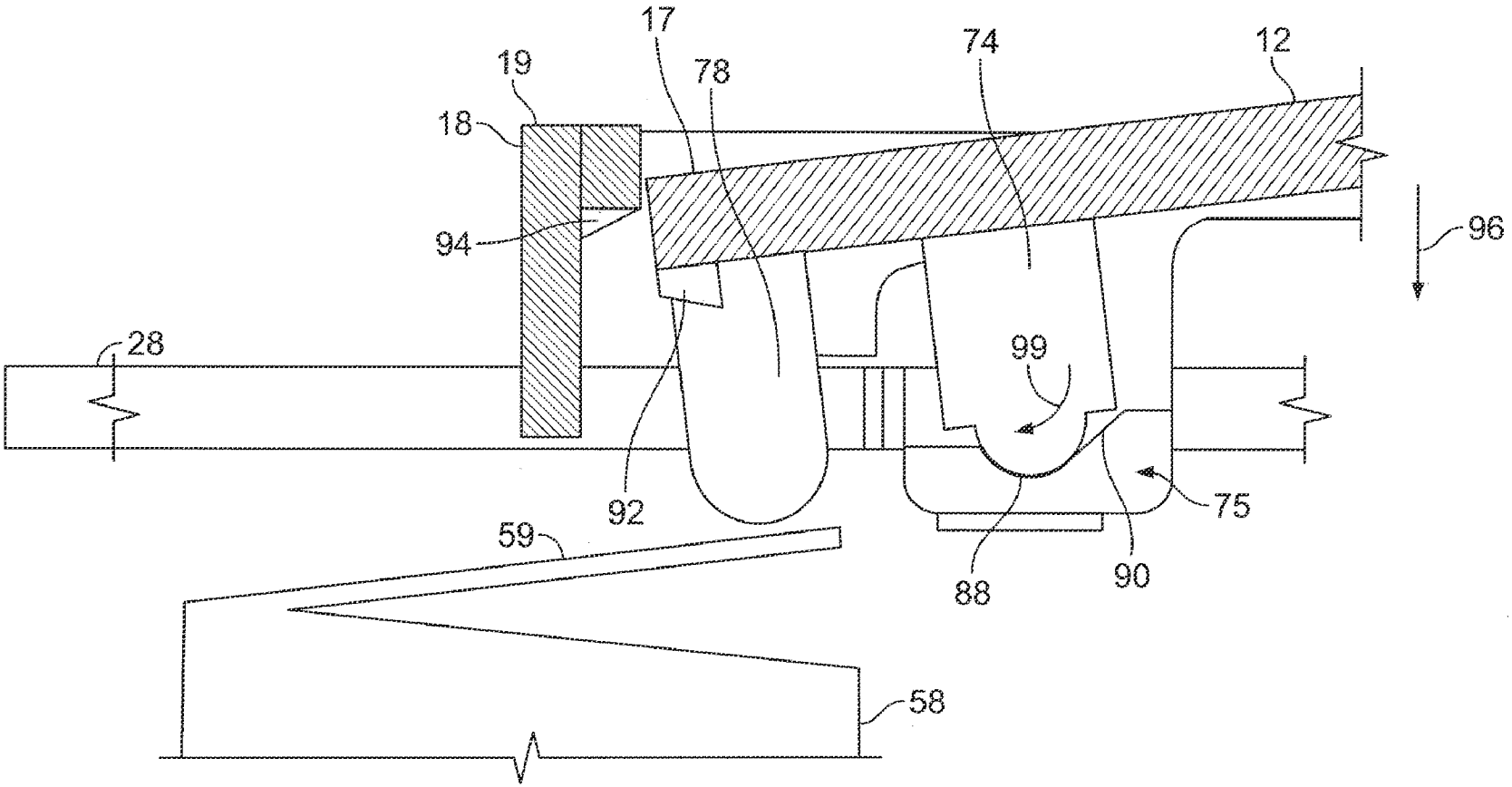
FIG. 4E is a detailed view of the coupling mechanism of the dimmer of FIG. 4D being moved from the disconnected position back to the operational position.

FIG. 4E shows a detailed view of the coupling mechanism of the dimmer as it is restored to its operational position (FIG. 4A) from its disconnected position (FIG. 4C). A user moves the bottom portion of main actuator 12 in the direction of arrow 96 to allow the top edge of the main actuator 12 to clear the ribs 94 of the frame 18 (compare FIGS. 4C and 4D). The main actuator 12 is then urged further in the direction of arrow 96 toward the frame 18 which causes the pivots 74 to slide in the direction of arrow 99 from the second pivot holder surface 90 to the first pivot holder surface 88 (see FIG. 4E). As the main actuator 12 is urged further toward frame 18, the latch 82 makes contact with the bottom portion of frame 18 where it is held in place, as shown in FIG. 4A. Air-gap actuator 78 is thus moved away from air-gap switch 58 (compare FIGS. 4D and 4E), releasing pressure on lever 59 so that the air-gap switch returns to its ON position, thereby allowing a user to operate the dimmer 10.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

The invention claimed is:

1. An electronic dimmer switch comprising:

an air-gap switch for coupling to a power source;

a power switch connected in series with the air-gap switch, said power switch electronically controlling power to a load;

a dimmer module, connected to the power switch, for coupling to the load to deliver an adjustable level of power to the load; and a main actuator movable between an operational position and a disconnected positions wherein the main actuator is configured to act as a single control mechanism for selectively engaging either the power switch when in the operational position or the air-gap switch when in the disconnected position.

2. A dimmer switch according to claim 1, wherein movement of the main actuator from the operational position to the disconnected position is effective to open the air-gap switch.

3. A dimmer switch according to claim 1, further comprising a frame having an opening for accommodating the main actuator, the main actuator being pivotally and slidably coupled to the frame.

4. A dimmer switch according to claim 3, wherein a coupling between the main actuator and the frame includes at least one pivot in a pivot holder, the pivot having an end with a partial cylindrical surface in contact with a surface of the pivot holder, said surface including a first portion having a partial cylindrical surface and a second portion having a ramp surface.

5. A dimmer switch according to claim 4, wherein movement of the main actuator from the operational position to the disconnected position causes the pivot to rotate with respect to the first portion of said surface and subsequently slide with respect to the second portion of said surface.

6. A dimmer switch according to claim 4, wherein in accordance with said movement of the main actuator from the operational position to the disconnected position, a sliding movement of the main actuator causes a portion of the main actuator to slide under a portion of the frame.

7. A dimmer switch according to claim 3, wherein the frame further comprises a rib portion for contacting an edge of the main actuator to hold the main actuator in the disconnected position.

8. A dimmer switch according to claim 3, wherein a coupling between the main actuator and the frame includes at least one pivot in a pivot holder, the pivot holder being disposed near one end of the frame, and the main actuator includes a latch configured to be detachably coupled to an opposite end of the frame.

9. A dimmer switch according to claim 3, wherein the main actuator and the frame each have a front face, the main actuator in the operational position has the front face thereof in relatively the same plane as the front face of the frame, and the main actuator in the disconnected position has the front face thereof in a plane diagonal to the plane of the front face of the frame.

10. A dimmer switch according to claim 3, wherein the main actuator includes at least one pivot and the frame includes a pivot holder for holding the pivot, the pivot having an end with a partial cylindrical surface in contact with a surface of the pivot holder, said surface including a first portion having a partial cylindrical surface and a second portion having a ramp surface, the main actuator in the operational position has the pivot resting on the first portion of said surface, and the main actuator in the disconnected position has the pivot resting on the second portion of said surface.

11. A dimmer switch according to claim 3, wherein the main actuator includes a stop element for limiting rotation of the main actuator with respect to the frame.

12. A dimmer switch according to claim 3, wherein the main actuator and the frame form an assembly detachably coupled to the dimmer module.

13. A dimmer switch according to claim 1, wherein said air-gap switch is a normally-closed switch, so that said air-gap switch is closed in accordance with the main actuator being in the operational position.

14. A dimmer switch according to claim 1, wherein the air-gap switch includes a lever in contact with the main actuator.

15. A dimmer switch according to claim 14, wherein the main actuator in the operational position is in engagement with the lever so that the air-gap switch is not actuated, and the main actuator in the disconnected position has the air-gap switch actuator in engagement with the lever so that the air-gap switch is actuated, thereby disconnecting the dimmer switch from the power source.

16. A dimmer switch according to claim 15, further comprising a frame having a central opening for accommodating the main actuator, the frame having an additional opening for accommodating the dimmer actuator.

17. A dimmer switch according to claim 1, further comprising a dimmer actuator coupled to the dimmer module, and wherein movement of the dimmer actuator is effective to adjust the level of power delivered to the load.

18. A dimmer switch according to claim 1, further comprising an intensity indicator for indicating the level of power delivered to the load, and a frame having a central opening for accommodating the main actuator and an additional opening to provide visibility of the intensity indicator.

19. A dimmer switch according to claim 1, further comprising a power indicator for indicating a status of the power switch, and a frame having a central opening for accommodating the main actuator and an additional opening to provide visibility of the power indicator.

20. A dimmer switch according to claim 1 wherein said dimmer module further comprises circuitry selected from the group consisting of a switching-mode power supply, a rheostat, an autotransformer, solid-state circuitry, a thyristor, a silicon-controlled rectifier, and a triac.

21. An electronic dimmer switch, said switch being implemented at least in part using an electronic circuit on a printed circuit board, said switch comprising:

an air-gap switch for coupling to a power source;

a power switch connected in series with the air-gap switch, said power switch electronically controlling power to a load;

a dimmer module, connected to the power switch, for coupling to the load to deliver an adjustable level of power to the load; and a main actuator movable between an operational position and a disconnected position, wherein the main actuator is configured to act as a single control mechanism for selectively engaging either the power switch when in the operational position or the air-gap switch when in the disconnected position.

* * * * *

UNITED STATES PATENT AND TRADEMARK OFFICE

CERTIFICATE OF CORRECTION

PATENT NO. : 8,003,904 B2
APPLICATION NO. : 11/675329
DATED : August 23, 2011
INVENTOR(S) : Yun Wu It is certified that error appears in the above-identified patent and that said Letters Patent is hereby corrected as shown below:

In the Claims

Claim 1, Column 9, lines 4-5, "a main actuator movable between an operational position and a disconnected positions" should read "a main actuator movable between an operational position and a disconnected position;"

Signed and Sealed this
Fourteenth Day of January, 2014

Michelle K. Lee

Michelle K. Lee
*Deputy Director of the United States Patent and Trademark Office*